US005706953A

United States Patent [19]

Polvere

[11] Patent Number: 5,706,953

[45] Date of Patent: Jan. 13, 1998

[54] COMBINATION SHIPPING CARTON AND DISPLAY STAND FORMED WITH INSERT PANELS AND SHELVES

[75] Inventor: Dennis J. Polvere, Freehold, N.J.

[73] Assignee: Resources Inc. In Display, Cranford, N.J.

[21] Appl. No.: 658,060

[22] Filed: Jun. 4, 1996

[51] Int. Cl.[6] ..... B65D 5/44

[52] U.S. Cl. ..... 206/736; 206/756

[58] Field of Search ..... 206/736, 740, 206/741, 742, 743, 744, 756, 757, 758, 216, 775

[56] References Cited

U.S. PATENT DOCUMENTS 2,018,521 10/1935 Wilke ..... 206/744

3,927,761 12/1975 Boyle ..... 206/756

*Primary Examiner*—Jacob K. Ackun

*Attorney, Agent, or Firm*—Cooper & Dunham LLP

[57] ABSTRACT

A carton adapted to be used as a shipping carton for shipping merchandise and a display stand for displaying the merchandise, and a carton blank from which the combination shipping carton and display stand is formed therefrom. The carton includes a top wall, a bottom wall, a first side wall, a second side wall, a plurality of insert panels including a first insert panel connected to a first inner side panel, a second insert panel connected to a second inner side panel, and a third insert panel connected to a first rear panel and a second rear panel, and a plurality of shelves. The plurality of insert panels provide rigidity to the combination shipping carton and display stand and also allow the plurality of shelves to be removably connected to the plurality of insert panels.

25 Claims, 4 Drawing Sheets

FIG.3A
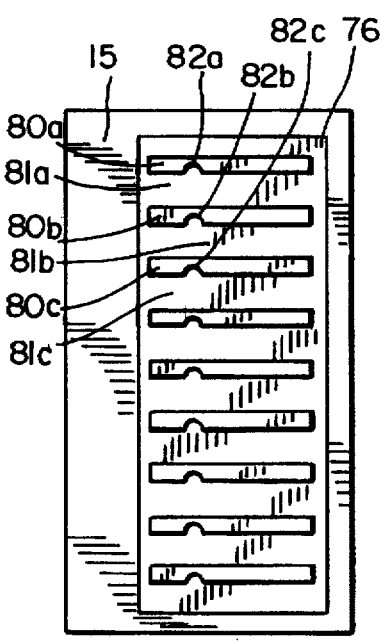
FIG.3B
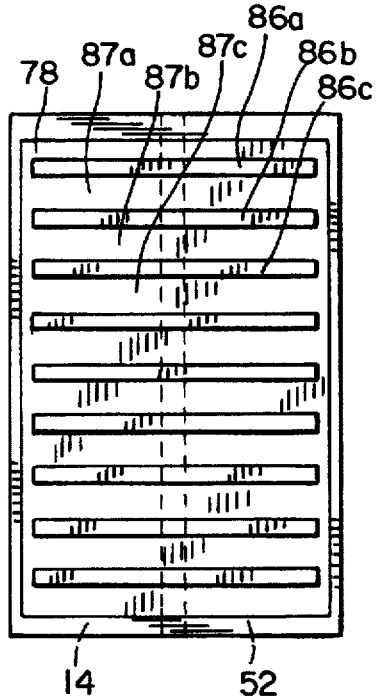
FIG.3C
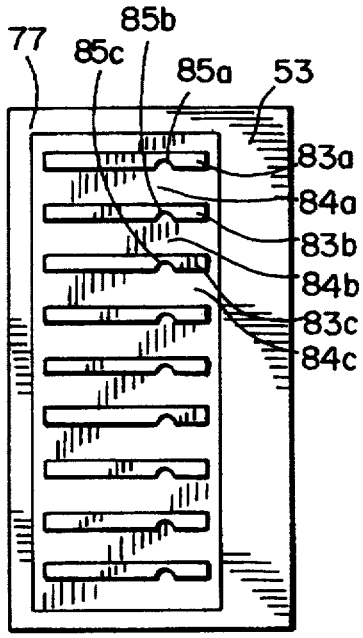
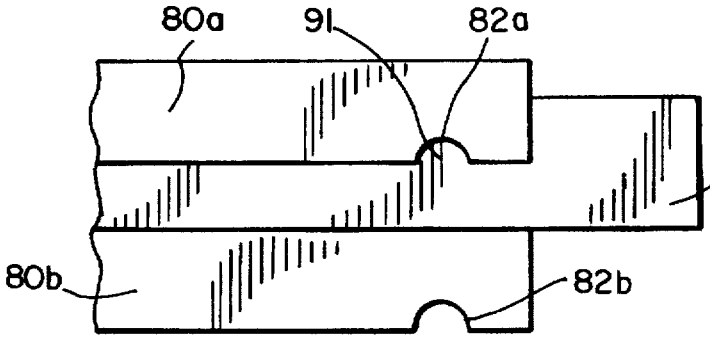
FIG.4
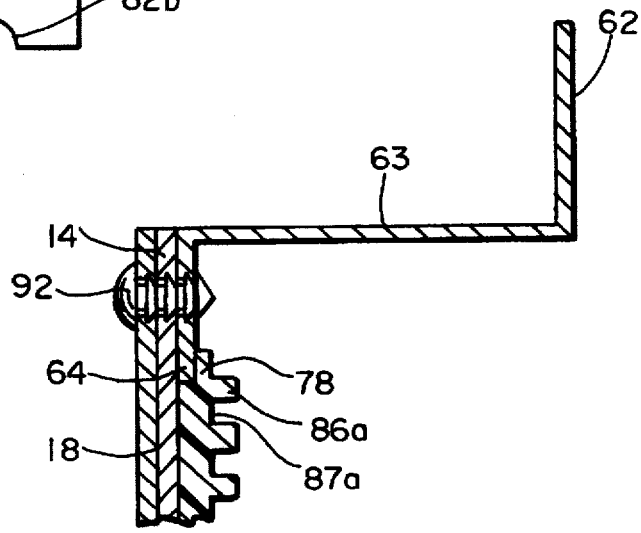
FIG.5

COMBINATION SHIPPING CARTON AND DISPLAY STAND FORMED WITH INSERT PANELS AND SHELVES

BACKGROUND OF THE INVENTION

1. Field of the Invention

The present invention relates to the art of shipping cartons and display stands, more particularly, to a device used as both a shipping carton for shipping merchandise and display stand for displaying the merchandise.

2. Description of the Related Art

Various devices for displaying merchandise offered for sale have been developed. Conventional display devices which are structurally constructed to adequately support and display a heavy load of merchandise usually require specialized parts and also require skilled labor to assemble. Additionally, these structurally sound display devices are generally not adapted to be used as shipping cartons for shipping the merchandise.

Other conventional shipping cartons which are used to ship merchandise generally do not also function as display devices. However, shipping cartons which are also used to display merchandise generally are not constructed to adequately support and display a heavy load of merchandise. Such devices are generally constructed entirely of a lightweight material, i.e., cardboard, that may not be able to accommodate a heavy load of merchandise. Additionally, these devices generally do not allow shelves to be readily and easily adjusted to accommodate the variety of shapes and sizes of the merchandise to be displayed.

Overall, conventional devices for shipping merchandise have provided satisfactory results for their intended purpose. Other conventional devices for displaying merchandise offered for sale have provided satisfactory results for their intended purpose. However, a need exists for a structurally sound, economically manufactured, and easily assembled device which can be used for both a shipping carton and a display stand.

OBJECTS AND SUMMARY OF THE INVENTION

The present invention generally relates to a combination shipping carton and display stand, and a carton blank from which the combination shipping carton and display stand is formed. The combination shipping carton and display stand is designed to be structurally sound, economically manufactured, and easily assembled.

The shipping carton is adequately manufactured for shipping merchandise. In one embodiment, the combination of cardboard panels and plastic insert panels can be economically manufactured and provide increased rigidity thereto. Such a construction allows the device to also be utilized as a display stand to adequately support and display the merchandise offered for sale and enable the display stand and shipping carton to be easily assembled without requiring skilled labor. The plurality of shelves include rims and, in one embodiment, the shelves are made of plastic. The combination of shelves and insert panels allow the spacing between the shelves to be adjusted and, thus, the display stand can accommodate a variety of merchandise having various sizes and shapes. In addition, such a construction allows the combination shipping carton and display stand to be structurally sound and, thus, adequately accommodate a heavy load of merchandise.

It is an object of the present invention to provide a carton blank which can be adapted to form both a shipping carton and a display stand.

It is a further object of the present invention to provide a carton which can be used as both a shipping carton and a display stand for adequately shipping, supporting, and displaying a variety of merchandise having various sizes, shapes, and weight.

It is another object of the present invention to provide a combination shipping carton and display stand which is constructed to be structurally sound, economically manufactured, readily assembled, and aesthetically appealing.

It is an additional object of the present invention to provide a display stand in which a plurality of shelves are removably secured by insert panels and the spacing between the plurality of shelves can be easily adjusted.

The above and other features and advantages of the present invention will become apparent from the following description which will be given with reference to the illustrative accompanying drawings.

BRIEF DESCRIPTION OF THE DRAWINGS

FIG. 3(*a*) is a sectional view of an embodiment of a first insert panel connected to a first inner side panel of the combination shipping carton and display stand from FIG. 2;

FIG. 3(*b*) is a sectional view of an embodiment of a third insert panel connected to a first rear panel and a second rear panel of the combination shipping carton and display stand from FIG. 2;

FIG. 3(*c*) is a sectional view of an embodiment of a second insert panel connected to a second inner side panel of the combination shipping carton and display stand from FIG. 2;

FIG. 4 is a side sectional view of an embodiment of a portion of a shelf being supported by a plurality of ribs;

FIG. 5 is a side sectional view showing fastening means for fastening a portion of the combination shipping carton and display stand from FIG. 2.

DESCRIPTIONS OF PREFERRED EMBODIMENTS

Figure 1:
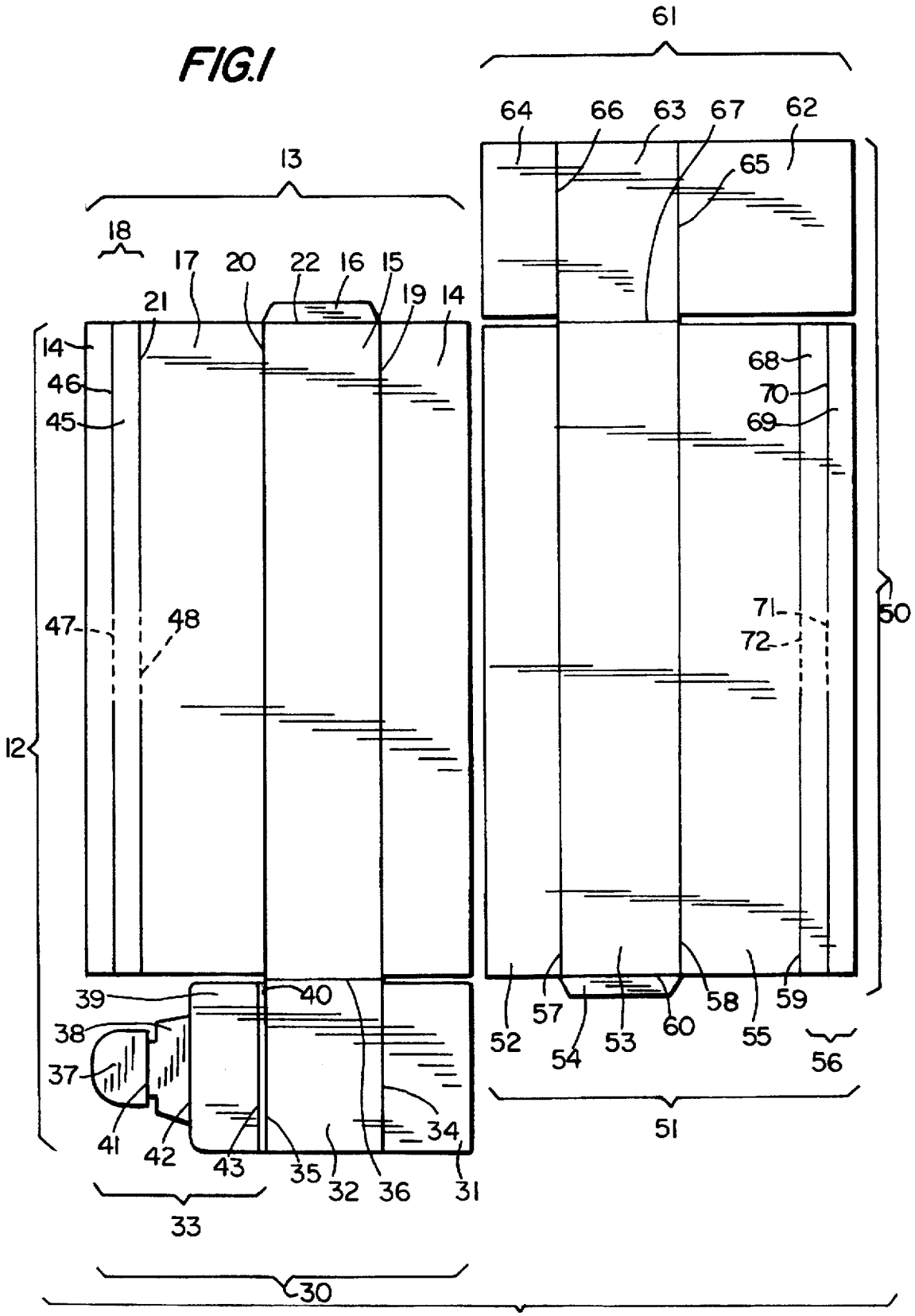
FIG. 1 is a front elevational view showing an embodiment of a carton blank of the present invention.

FIG. 1 illustrates a front elevational view of a preferred embodiment of a carton blank 11 of the present invention. One aspect of the present invention includes a carton blank 11 adapted to form a shipping carton 93 and a display stand 75. The carton blank 11 includes a first blank 12 and a second blank 50. Although in an alternative embodiment, the carton blank 11 may be manufactured from one unitary blank, in a preferred embodiment as shown in FIG.1, the carton blank 11 is constructed from a first blank 12 and a second blank 50. Constructing the carton blank 11 from two blanks 12, 50, instead of one blank may result in an economically manufactured carton blank 11. For instance, manufacturing the carton blank 11 from two blanks 12, 50, may allow stock sizes of material, i.e., cardboard, to be used and may also reduce the amount of material which would otherwise be wasted.

As shown in FIG. 1, the first blank 12 includes a first side wall 13 and a bottom wall 30. The first side wall 13 includes a first rear panel 14, a first inner side panel 15, a first side wall flap 16, a first outer side panel 17, a first end flap 18, a crease 19 located between the first rear panel 14 and the first inner side panel 15, a crease 20 located between the first inner side panel 15 and the first outer side panel 17, a crease 21 located between the first outer side panel 17 and the first end flap 18, and a crease 22 located between the first inner side panel 15 and the first side wall flap 16. Additionally, the crease 21 may include a second slit 48. The plurality of creases typically illustrated at 19, 20, 21, 22, may be formed by any conventional method, i.e., scoring, which will allow respective adjacent panels to be divided by each of the plurality of creases 19, 20, 21, 22, and to move the respective panels in a folding motion.

The first blank 12, as illustrated in FIG. 1, also includes a bottom wall 30. The bottom wall 30 includes a bottom wall flap 31, a floor panel 32, an end panel 33, a crease 34 located between the bottom wall flap 31 and the floor panel 32, and a crease 35 located between the floor panel 32 and the end panel 33. Additionally, the first blank 12 includes a crease 36 located between the first inner side panel 15 and the floor panel 32.

The second blank 50, as shown in FIG. 1, includes a second side wall 51 and a top wall 61. The second side wall 51 includes a second rear panel 52, a second inner side panel 53, a second side wall flap 54, a second outer side panel 55, a second end flap 56, a crease 57 located between the second rear panel 52 and the second inner side panel 53, a crease 58 located between the second inner side panel 53 and the second outer side panel 55, a crease 59 located between the second outer side panel 55 and the second end flap 56, and a crease 60 located between the second inner side panel 53 and the second side wall flap 54.

The crease 59 located between the second outer panel 55 and the second end flap 56 may include a fourth slit 72. The top wall 61 of the second blank 50, as illustrated in FIG. 1, also includes a front panel 62, a center panel 63, a top wall flap 64, a crease 65 located between the front panel 62 and the center panel 63, and a crease 66 located between the center panel 63 and the top wall flap 64. Additionally, the second blank 50 includes a crease 67 located between the second inner side panel 53 and the center panel 63.

In one embodiment, as shown in FIG. 1, the end panel 33 includes a first portion 37, a second portion 38, a third portion 39, a fourth portion 40, a crease 41 located between the first portion 37 and the second portion 38, a crease 42 located between the second portion 38 and the third portion 39, a crease 43 located between the third portion 39 and the fourth portion 40. The first end flap 18 may include a first member 44, a second member 45, and a crease 46 located between the first member 44 and the second member 45. Additionally, the crease 46 may include a first slit 47. The second end flap 56 may include a third member 68, a fourth member 69, and a crease 70 located between the third member 68 and the fourth member 69. Additionally, the crease 70 located between the third member 68 and the fourth member 69 may include a third slit 71.

Figure 2:
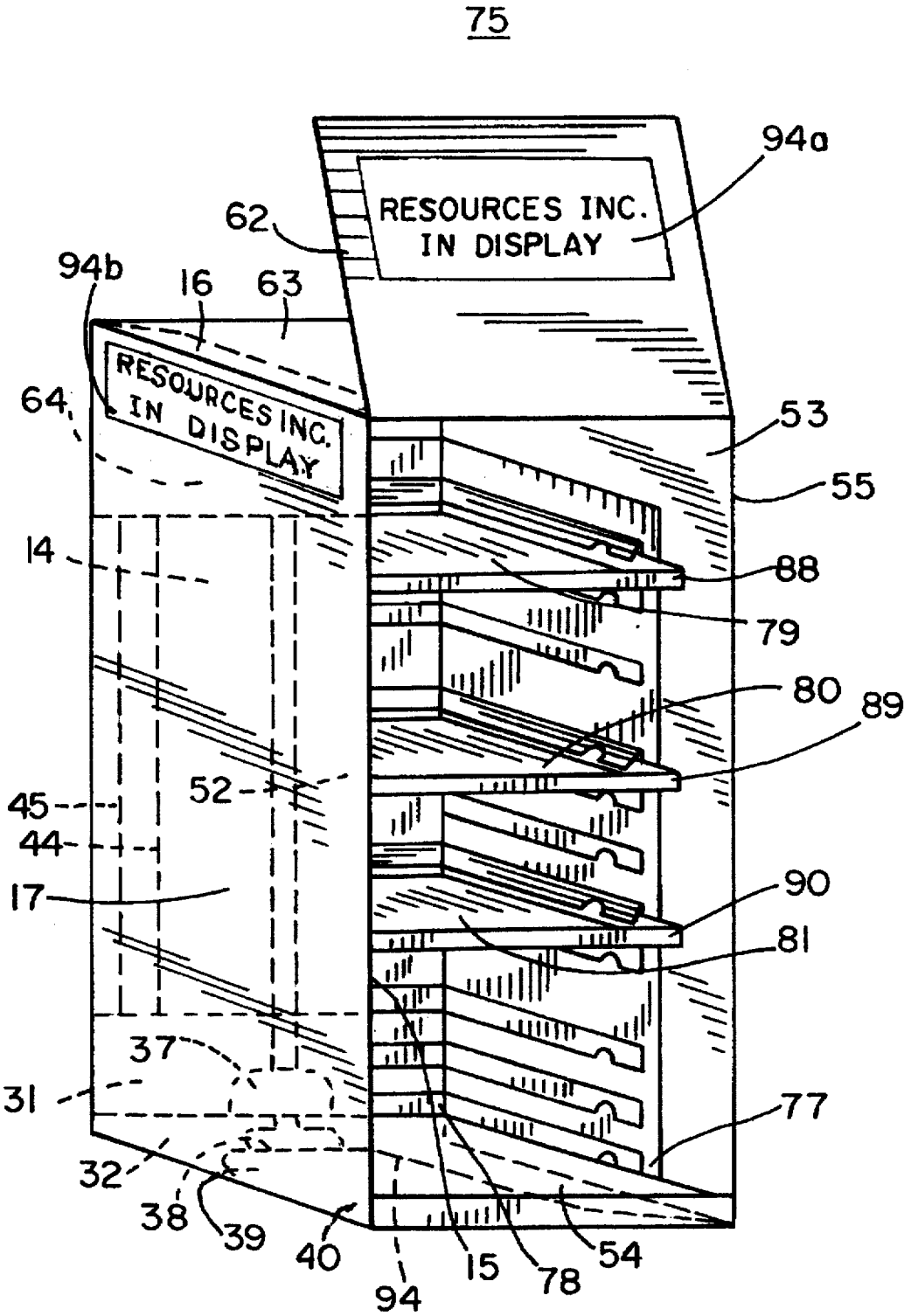
FIG. 2 is a perspective view of a preferred embodiment of a combination shipping carton and display stand in a display state formed from the carton blank from FIG. 1.
Figure 6:
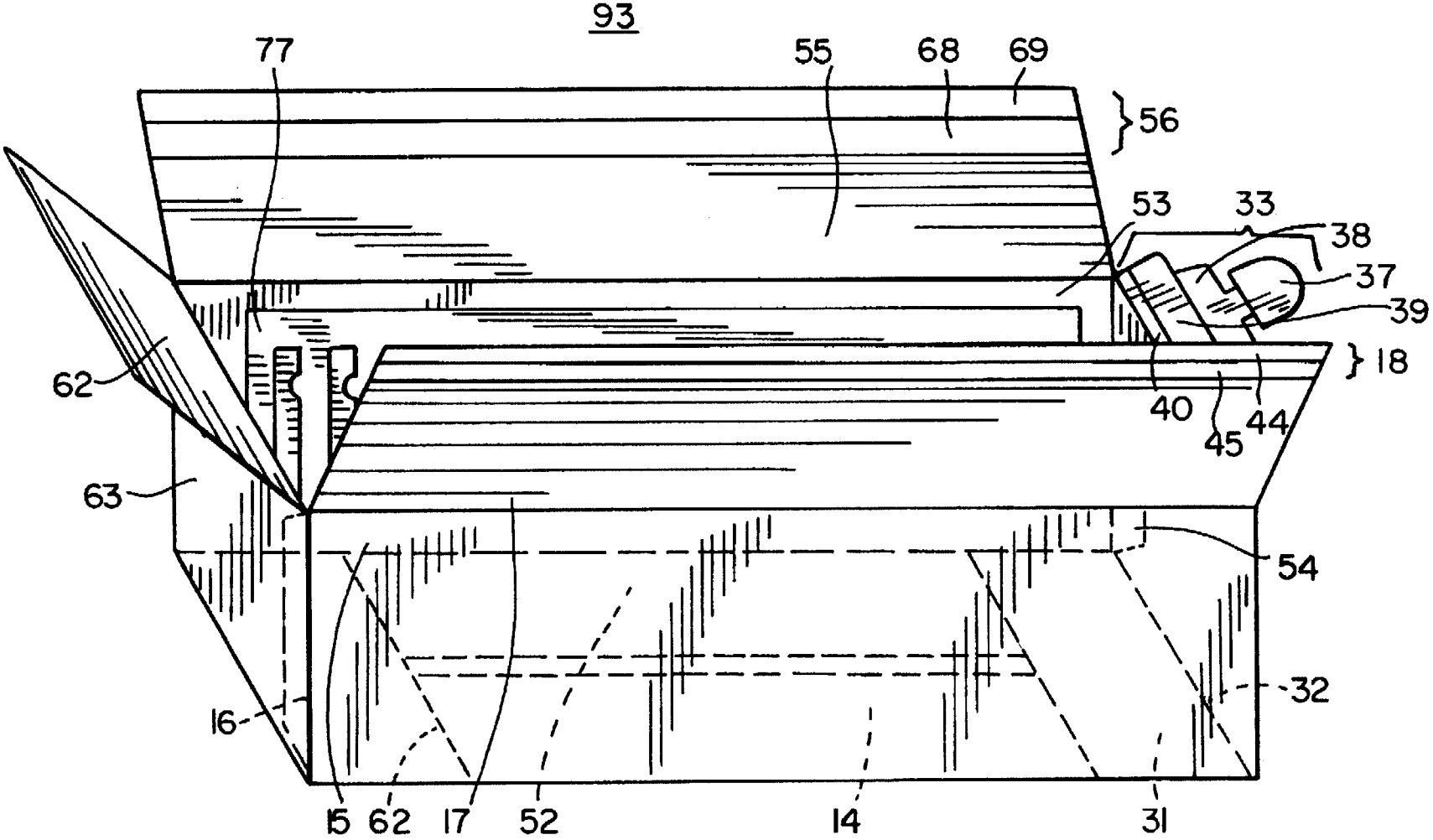
FIG. 6 is a perspective view showing an embodiment of the combination shipping carton and display stand of the present invention in a shipping state formed from the carton blank from FIG. 1.

The present invention also includes the carton blank 11 from FIG. 1 assembled in a display state and a shipping state. The shipping state may further include an unloaded shipping state and a loaded shipping state. The unloaded shipping state represents the carton blank 11 assembled into a shipping state and not yet containing the merchandise to be loaded therein. The loaded shipping state represents the carton blank 11 assembled into a shipping state and also contains the merchandise loaded therein. The same carton blank 11 that can be used for a shipping carton 93, as illustrated in FIG. 6, and a display stand 75, as illustrated in FIG. 2, may provide significant cost savings in the manufacturing and storing of such a product.

In one embodiment, the carton blank 11 from FIG. 1 is assembled into a display state by folding the first rear panel 14 along the crease 19 with respect to the first inner side panel 15 forming an angle of substantially 90 degrees therewith. The second rear panel 52 is folded along the crease 57 with respect to the second inner side panel 53 forming an angle of substantially 90 degrees therewith. The center panel 63 is folded along the crease 67 with respect to the second inner side panel 53 forming an angle of substantially 90 degrees therewith. The top wall flap 64 is folded along the crease 66 with respect to the center panel 63 forming an angle of substantially 90 degrees therewith. The top wall flap 64 is connected to the first rear panel 14 and the second rear panel 52. The first side wall flap 16 is folded along the crease 22 with respect to the first inner side panel 15 forming an angle of substantially 90 degrees therewith. The first side wall flap 16 is connected to the center panel 63. The floor panel 32 is folded along the crease 36 with respect to the first inner side panel 15 forming an angle of substantially 90 degrees therewith. The bottom wall flap 31 is folded along the crease 34 with respect to the floor panel 32 forming an angle of substantially 90 degrees therewith. The bottom wall flap 31 is connected to the first rear panel 14 and the second rear panel 52. The second side wall flap 54 is folded along the crease 60 with respect to the second inner side panel 53 forming an angle of substantially 90 degrees therewith. The second side wall flap 54 is connected to the floor panel 32.

The carton blank 11 from FIG. 1 is assembled into a display state by also folding the first outer side panel 17 along the crease 20 with respect to the first inner side panel 15, whereby the first outer side panel 17 substantially contacts the first inner side panel 15, thus, forming an angle of substantially 0 degrees therewith. The second outer side panel 55 is folded along the crease 58 with respect to the second inner side panel 53, whereby the second outer side panel 55 substantially contacts the second inner side panel 53, thus, forming an angle of substantially 0 degrees therewith. The first end flap 18 is folded along the crease 21 with respect to the first outer side panel 17 forming an angle of substantially 90 degrees therewith. The first end flap 18 is connected to the first rear panel 14. The second end flap 56 is folded along the crease 59 with respect to the second outer side panel 55 forming an angle of substantially 90 degrees therewith. The second end flap 56 is connected to the second rear panel 52. The second portion 38, the third portion 39, and the fourth portion 40, are folded along the crease 35 with respect to the floor panel 32, whereby the second portion 38, the third portion 39, and the fourth portion 40, substantially contact the floor panel 32, thus, forming an angle of substantially 0 degrees therewith. The first portion 37 is folded along the crease 41 with respect to the second portion 38, the third portion 39, and the fourth portion 40, forming an angle of substantially 90 degrees therewith. The first portion 37 is connected to the first rear panel 14 and the second rear panel 52. In addition, the front panel 62 extends upward from the center panel 63 and forms an angle substantially in a range of 45 degrees to 90 degrees therewith. In a preferred embodiment, the front panel 62 and the center panel 63 form an angle of substantially 90 degrees therewith.

In another embodiment, the carton blank 11 from FIG. 1 is assembled into a shipping state, i.e., loaded and unloaded, by folding the first rear panel 14 along the crease 19 with respect to the first inner side panel 15 forming an angle of substantially 90 degrees therewith. The second rear panel 52 is folded along the crease 57 with respect to the second inner side panel 53 forming an angle of substantially 90 degrees therewith. The center panel 63 is folded along the crease 67 with respect to the second inner side panel 53 forming an angle of substantially 90 degrees therewith. The top wall flap 64 is folded along the crease 66 with respect to the center panel 63 forming an angle of substantially 90 degrees therewith. The top wall flap 64 is connected to the first rear panel 14 and the second rear panel 52. The first side wall flap 16 is folded along the crease 22 with respect to the first inner side panel 15 forming an angle of substantially 90 degrees therewith. The first side wall flap 16 is connected to the center panel 63. The floor panel 32 is folded along the crease 36 with respect to the first inner side panel 15 forming an angle of substantially 90 degrees therewith. The bottom wall flap 31 is folded along the crease 34 with respect to the floor panel 32 forming an angle of substantially 90 degrees therewith. The bottom wall flap 31 is connected to the first rear panel 14 and the second rear panel 52. The second side wall flap 54 is folded along the crease 60 with respect to the second inner side panel 53 forming an angle of substantially 90 degrees therewith. The second side wall flap 54 is connected to the floor panel 32.

The carton blank 11 from FIG. 1 is assembled into a shipping state, i.e., loaded and unloaded, by additionally folding the first outer side panel 17 and the first end flap 18, along the crease 20 with respect to the first inner side panel 15. In the carton blank's unloaded shipping state, the first outer side panel 17 and the first end flap 18, form an angle of substantially 0 degrees with respect to the first inner side panel 15. In the carton blank's loaded shipping state, the first outer side panel 17 and the first end flap 18, form an angle of substantially 90 degrees with respect to the first inner side panel 15. The second outer side panel 55 and the second end flap 56, are folded along the crease 58 with respect to the second inner side panel 53. In the carton blank's unloaded shipping state, the second outer side panel 55 and the second end flap 56, form an angle of substantially 0 degrees with respect to the second inner side panel 53. In the carton blank's loaded shipping state, the second outer side panel 55 and the second end flap 56, form an angle of substantially 90 degrees with respect to the second inner side panel 53. The end panel 33 is folded along the crease 35 with respect to the floor panel 32. In the carton blank's unloaded shipping state, the end panel 33 forms an angle of substantially 0 with respect to the floor panel 32. In the carton blank's loaded shipping state, the end panel 33 forms an angle of substantially 90 degrees with respect to the floor panel 32.

The carton blank 11 from FIG. 1 is assembled into a shipping state, i.e., loaded and unloaded, by additionally folding the front panel 62 along the crease 65 with respect to the center panel 63. In the carton blank's unloaded shipping state, the front panel 62 forms an angle of substantially 0 degrees with respect to the center panel 63. In the carton blank's loaded shipping state, the front panel 62 forms an angle of substantially 90 degrees with respect to the center panel 63. In addition, in the carton blank's loaded shipping state, the first outer side panel 17 and first end flap 18; and the second outer side panel 55 and second end flap 56, are connected to each other. In an alternate embodiment, the end panel 33 may be connected to the first outer side panel 17 and first end flap 18 and the second outer side panel 55 and second end flap 56. In addition, the front panel 62 may be connected to the first outer side panel 17 and first end flap 18; and the second outer side panel 55 and the second end flap 56. Although, in the carton blank's unloaded shipping state, the first outer side panel 17 and first end flap 18, the second outer side panel 55 and second end flap 56, the end panel 33, and the front panel 62, were described as forming an angle of substantially 0 degrees with the above-mentioned respective panels, any angle which would allow access to the merchandise holding area formed by the assembled carton blank would be within the scope of the present invention. The display stand 75, as shown in a preferred embodiment illustrated in FIG. 2, includes a top wall 61, a bottom wall 30, a first side wall 13 located adjacent to the bottom wall 30, a second side wall 51 located adjacent to the top wall 61, a plurality of insert panels typically illustrated at 76, 77, 78, connected to the first side wall 13 and the second side wall 51, and a plurality of shelves typically illustrated at 79, 80, 81, which removably connect to the plurality of insert panels 76, 77, 78. Although the plurality of insert panels 76, 77, 78, and the plurality of shelves 79, 80, 81, may be made of any suitable material, in a preferred embodiment the plurality of insert panels 76, 77, 78, and the plurality of shelves 79, 80, 81, are made of plastic. Such a construction provides rigidity to the display stand 75 and allows the plurality of shelves 79, 80, 81, to be removably connected to the plurality of insert panels 76, 77, 78. Additionally, the plurality of insert panels 76, 77, 78, and the plurality of shelves 79, 80, 81, may be manufactured by injection molding, vacuum forming, or any conventional method of manufacturing.

In one embodiment, as shown in FIG. 2, the top wall 61 of the display stand 75 includes a front panel 62, a top wall flap 64, and a center panel 63 located between the front panel 62 and the top wall flap 64. The bottom wall 30 may include a bottom wall flap 31, an end panel 33, and a floor panel 32 located between the bottom wall flap 31 and the end panel 33. The first side wall 13 may include a first rear panel 14, a first inner side panel 15 located adjacent to the first rear panel 14, a first side wall flap 16 located adjacent to the first inner side panel 15, a first end flap 18, and a first outer side panel 17 located between the first inner side panel 15 and the first end flap 18. The second side wall 51 may include a second rear panel 52, a second inner side panel 53 located adjacent to the second rear panel 52, a second side wall flap 54 located adjacent to the second inner side panel 53, a second end flap 56, and a second outer side panel 55 located between the second inner side panel 53 and the second end flap 56. Additionally, the front panel 62, the first outer side panel 17, and the second outer side panel 55 may further include advertising means for displaying advertisements, i.e., the name of a company, corporation, or product, typically illustrated at **94*a*, 94*b*, in FIG. 2. The advertisement means 94*a*, 94*b*, may also add to the aesthetic appeal of the combination shipping carton and display stand. In addition, the advertising means 94*a*, 94*b***, can incorporate information relating to the merchandise displayed and offered for sale, thus, increasing the marketability and visibility thereof.

In one embodiment, as illustrated in FIG. 2, the end panel 33 of the display stand 75 includes a first portion 37, a second portion 38 located adjacent to the first portion 37, a third portion 39 located adjacent to the second portion 38, and a fourth portion 40 located adjacent to the third portion 39. The first end flap 18 may include a first member 44, a second member 45 located adjacent to the first member 44. The second end flap 56 may include a third member 68, and a fourth member 69 located adjacent to the third member 68. Additionally, the display stand 75 may include a base member 94 proximately located to the bottom wall 30. The base member 94 provides additional stability and rigidity to the combination shipping carton and display stand.

In one embodiment the plurality of insert panels 76, 77, 78, as illustrated in FIGS. 3(*a*), 3(*b*), and 3(*c*), include a first insert panel 76 connected to a first inner side panel 15, a second insert panel 77 connected to a second inner side panel 53, and a third insert panel 78 connected to a first rear panel 14 and a second rear panel 52, respectively. Each of the plurality of insert panels 76, 77, 78, include a plurality of ribs typically illustrated at 80*a* . . . 80*c*, 83*a* . . . 83*c*, 86*a* . . . 86*c*, and a plurality of slots typically illustrated at 81*a* . . . 81*c*, 84*a* . . . 84*c*, 87*a* . . . 87*c*. The plurality of ribs 80*a* . . . 80*c* of the first insert panel 76 and the plurality of ribs 83*a* . . . 83*c* of the second insert panel 77 include a plurality of notches, 82*a* . . . 82*c*, 85*a* . . . 85*c*, respectively.

The plurality of shelves 79, 80, 81, of the display stand 75 include rims 88, 89, 90, respectively thereon. A pair of finger members typically illustrated at 91 in FIG. 4 are formed on each of the plurality of rims 88, 89, 90. FIG. 4 is a side sectional view of an embodiment of a typical arrangement of a portion of a shelf 79 supported by a plurality of ribs 80*a*, 80*b*, and depicts the shelf 79 removably inserted into the slot 81*a* and a finger member 91 engaged with a notch 82*a* of a rib 80*a*. The engagement between the pair of finger members 91 of each of the shelves 88, 89, 90, and the respective notches 82*a* . . . 82*c*, 85*a* . . . 85*c*, of the plurality of ribs 80*a* . . . 80*c*, 83*a* . . . 83*c*, enables the plurality of shelves 88, 89, 90, to be securely connected to the plurality of insert panels 88, 89, 90. In addition, such a construction ensures and provides an indication of the proper placement of the shelves 88, 89, 90.

In a preferred embodiment, the plurality of insert panels 77, 78, 79, and the plurality of shelves 88, 89, 90 , are made of plastic. The plurality of slots 81*a* . . . 81*c*, 84*a* . . . 84*c*, 87*a* . . . 87*c*, and the plurality of ribs 80*a* . . . 80*c*, 83*a* . . . 83*c*, 86*a* . . . 86*c*, allow the shelves 88, 89, 90, to be supported on, at least, three sides. Such a construction allows the shelves 88, 89, 90, to support a heavy load of merchandise. Furthermore, the respective notch 82*a* and finger member 91 arrangement allows the plurality of shelves 88, 89, 90, to be removed from and connected to the plurality of insert panels 88, 89, 90, and enables the spacing between the shelves 88, 89, 90, to be adjusted in an easy manner without requiring skilled labor, thus, accommodating merchandise of various sizes and shapes.

A display stand 75, in one embodiment, also includes fastening means typically illustrated at 92 in FIG. 5. The fastening means 92 connect the first end flap 18 to the first rear panel 14 and connect the second end flap 56 to the second rear panel 52. Although any conventional fastening means 92 may be used, i.e., glue, staples, tape, the preferred fastening means are arrow fasteners 92. Such fasteners 92 can be removably installed in an easy manner and adequately connect the first end flap 18 to the first rear panel 14 and connect the second end flap 56 to the second rear panel 52. Additionally, the fastening means 92 can also connect the bottom wall flap 31 to the first rear panel 14 and the second rear panel 52, and connect the top wall flap 64 to the first rear panel 14 and the second rear panel 52.

Referring to the drawings, and particularly FIGS. 1 and 6, the shipping carton 93, as shown in an embodiment illustrated in FIG. 6, assembled from the carton blank, shown in FIG. 1, includes a top wall 61, a bottom wall 30, a first side wall 13 located adjacent to the bottom wall 30, a second side wall 51 located adjacent to the top wall 61, a plurality of insert panels typically illustrated at 76, 77, 78, connected to the first side wall 13 and the second side wall 51, and a plurality of shelves typically illustrated at 79, 80, 81, which removably connect to the plurality of insert panels 76, 77, 78. Although the plurality of insert panels 76, 77, 78, and the plurality of shelves 79, 80, 81, may be made of any suitable material, in a preferred embodiment the plurality of insert panels 76, 77, 78, and the plurality of shelves 79, 80, 81, are made of plastic. Such a construction provides rigidity to the shipping carton 93 and allows the plurality of shelves 79, 80, 81, to be removably connected to the plurality of insert panels 76, 77, 78. Additionally, the plurality of insert panels 76, 77, 78, and the plurality of shelves 79, 80, 81, may be manufactured by injection molding, vacuum forming, or any conventional method of manufacturing.

In one embodiment, as shown in FIG. 6, the top wall 61 of the shipping carton 93 includes a front panel 62, a top wall flap 64, and a center panel 63 located between the front panel 62 and the top wall flap 64. The bottom wall 30 may include a bottom wall flap 31, an end panel 33, and a floor panel 32 located between the bottom wall flap 31 and the end panel 33. The first side wall 13 may include a first rear panel 14, a first inner side panel 15 located adjacent to the first rear panel 14, a first side wall flap 16 located adjacent to the first inner side panel 15, a first end flap 18, and a first outer side panel 17 located between the first inner side panel 15 and the first end flap 18. The second side wall 51 may include a second rear panel 52, a second inner side panel 53 located adjacent to the second rear panel 52, a second side wall flap 54 located adjacent to the second inner side panel 53, a second end flap 56, and a second outer side panel 55 located between the second inner side panel 53 and the second end flap 56.

In one embodiment, as illustrated in FIG. 6, the end panel 33 of the shipping carton 93 includes a first portion 37, a second portion 38 located adjacent to the first portion 37, a third portion 39 located adjacent to the second portion 38, and a fourth portion 40 located adjacent to the third portion 39. The first end flap 18 may include a first member 44, a second member 45 located adjacent to the first member 44. The second end flap 56 may include a third member 68, and a fourth member 69 located adjacent to the third member 68. Additionally, the shipping carton 93 may include a base member 94 proximately located to the bottom wall 30. The base member 94 provides additional stability and rigidity to the combination shipping carton and display stand.

In one embodiment the plurality of insert panels 76, 77, 78, as illustrated in FIGS. 3(*a*), 3(*b*), and 3(*c*), include a first insert panel 76 connected to a first inner side panel 15, a second insert panel 77 connected to a second inner side panel 53, and a third insert panel 78 connected to a first rear panel 14 and a second rear panel 52, respectively. Each of the plurality of insert panels 76, 77, 78, include a plurality of ribs typically illustrated at 80*a* . . . 80*c*, 83*a* . . . 83*c*, 86*a* . . . 86*c*, and a plurality of slots typically illustrated at 81*a* . . . 81*c* . . . 84*a* . . . 84*c*, 87*a* . . . 87*c*. The plurality of ribs 80*a* . . . 80*c* of the first insert panel 76 and the plurality of ribs 83*a* . . . 83*c* of the second insert panel 77 include a plurality of notches, 82*a* . . . 82*c*, 85 *a*. . . 85*c*, respectively.

The plurality of shelves 79, 80, 81, of the shipping carton 93 include rims 88, 89, 90, respectively thereon. A pair of finger members typically illustrated at 91 in FIG. 4 are formed on each of the plurality of rims 88, 89, 90. FIG. 4 is a side sectional view of an embodiment of a typical arrangement of a portion of a shelf 79 supported by a plurality of ribs 80*a*, 80*b*, and depicts the shelf 79 removably inserted into the slot 81*a* and a finger member 91 engaged with a notch 82*a* of a rib 80*a*. The engagement between the pair of finger members 91 of each of the shelves 88, 89, 90, and the respective notches 82*a* . . . 82*c*, 85*a* . . . 85*c*, of the plurality of ribs 80*a* . . . 80*c*, 83*a* . . . 83*c*, enables the plurality of shelves 88, 89, 90, to be securely connected to the plurality of insert panels 88, 89, 90. In addition, such a construction ensures and provides an indication of the proper placement of the shelves 88, 89, 90. In a preferred embodiment, the plurality of insert panels 77, 78, 79, and the plurality of shelves 88, 89, 90, are made of plastic. The respective notch 82*a* and finger member 91 arrangement, as typically shown in FIG. 4, allows the plurality of shelves 88, 89, 90, to be removed from and connected to the plurality of insert panels 88, 89, 90, in an easy manner without requiring skilled labor.

In an alternate embodiment, the plurality of shelves 79, 80, 81, may be stored in the shipping carton 93 along with the merchandise to be shipped, without the plurality of shelves 79, 80, 81, being inserted into the plurality of insert panels 76, 77, 78. Thus, the merchandise may be placed in the shipping carton 93 in an efficient manner without being hampered by the shelves 79, 80, 81, which are inserted into the insert panels 76, 77, 78. Additionally, the plurality of shelves 79, 80, 81, would arrive with the shipping carton 93 and merchandise. Thus, the display stand 75 may be readily assembled from the shipping carton 93.

Although the present invention has been described hereinabove with reference to some preferred embodiments thereof, it is to be understood that the invention is not limited to such embodiments alone, and a variety of other modifications and variations will be apparent to those skilled in the art without departing from the spirit of the invention.

The scope of the invention, thus, is to be determined solely by the appended claims.

I claim:

1. A carton blank adapted to form a shipping carton and a display stand comprising:

a first blank and a second blank;

said first blank including a first side wall and a bottom wall;

said first side wall including:

a first rear panel;

a first inner side panel;

a first side wall flap;

a first outer side panel;

a first end flap;

a crease located between said first rear panel and said first inner side panel;

a crease located between said first inner side panel and said first outer side panel;

a crease located between said first outer side panel and said first end flap;

a crease located between said first inner side panel and said first side wall flap; and said bottom wall including:

a bottom wall flap;

a floor panel;

an end panel;

a crease located between said bottom wall flap and said floor panel;

a crease located between said floor panel and said end panel; and a crease located between said first inner side panel and said floor panel; and said second blank including a second side wall and a top wall;

said second side wall including:

a second rear panel;

a second inner side panel;

a second side wall flap;

a second outer side panel;

a second end flap;

a crease located between said second rear panel and said second inner side panel;

a crease located between said second inner side panel and said second outer side panel;

a crease located between said second outer side panel and said second end flap;

a crease located between said second inner side panel and said second side wall flap; and said top wall including:

a front panel;

a center panel;

a top wall flap;

a crease located between said front panel and said center panel;

a crease located between said center panel and said top wall flap; and a crease located between said second inner side panel and said center panel.

2. A carton blank as recited in claim 1 wherein said end panel includes:

a first portion;

a second portion;

a third portion;

a fourth portion;

a crease located between said first portion and said second portion;

a crease located between said second portion and said third portion;

a crease located between said third portion and said fourth portion; and said first end flap includes:

a first member;

a second member;

a crease located between said first member and said second member; and said second end flap includes:

a third member;

a fourth member; and a crease located between said third member and said fourth member.

3. A carton blank as recited in claim 2 wherein said crease located between said first member and said second member includes a first slit;

said crease located between said first outer side panel and said first end flap includes a second slit;

said crease located between said third member and said fourth member includes a third slit; and said crease located between said second outer side panel and said second end flap includes a fourth slit.

4. A display stand for displaying merchandise comprising:

a top wall;

a bottom wall;

a first side wall located adjacent to said bottom wall;

a second side wall located adjacent to said top wall;

a plurality of insert panels connected to said first side wall and said second side wall;

a plurality of shelves which removably connect to said plurality of insert panels;

wherein said plurality of insert panels provide rigidity to the display stand and allow said plurality of shelves to be removably connected to said plurality of insert panels.

5. A display stand as recited in claim 4 wherein said plurality of insert panels are plastic.

6. A display stand as recited in claim 4 wherein said plurality of shelves are plastic.

7. A display stand as recited in claim 4 wherein said plurality of insert panels include:

a first insert panel connected to said first side wall;

a second insert panel connected to said second side wall;

each of said first insert panel and said second insert panel having a plurality of ribs and a plurality of slots; and each of said plurality of ribs of said first insert panel and said second insert panel having a notch.

8. A display stand as recited in claim 7 wherein each of said plurality of shelves include a rim;

a pair of finger members are formed on each of said rim;

wherein said plurality of shelves are removably inserted into said plurality of slots and said pair of finger members engage said notches of said plurality of ribs, respectively.

9. A display stand as recited in claim 8 wherein said top wall includes:

a front panel;

a top wall flap; and a center panel located between said front panel and said top wall flap;

said bottom wall includes:

a bottom wall flap;

an end panel; and a floor panel located between said bottom wall flap and said end panel; and said first side wall includes:

a first rear panel;

a first inner side panel located adjacent to said first rear panel;

a first side wall flap located adjacent to said first inner side panel;

a first end flap;

a first outer side panel located between said first inner side panel and said first end flap; and said second side wall includes:

a second rear panel;

a second inner side panel located adjacent to said second rear panel;

a second side wall flap located adjacent to said second inner side panel;

a second end flap; and a second outer side panel located between said second inner side panel and said second end flap.

10. A display stand as recited in claim 9 wherein said plurality of insert panels further include:

a third insert panel connected to said first rear panel and said second rear panel, and said third insert panel having a plurality of ribs and a plurality of slots.

11. A display stand as recited in claim 10 wherein said end panel includes:

a first portion;

a second portion located adjacent to said first portion;

a third portion located adjacent to said second portion;

a fourth portion located adjacent to said third portion; and said first end flap includes:

a first member;

a second member located adjacent to said first member; and said second end flap includes:

a third member; and a fourth member located adjacent to said fourth member.

12. A display stand as recited in claim 10 further comprising fastening means for connecting said first end flap to said first rear panel and connecting said second end flap to said second rear panel.

13. A display stand as recited in claim 4 further comprising a base member proximately located to said bottom wall.

14. A display stand as recited in claim 10 wherein said front panel, said first outer side panel, and said second outer side panel further comprise advertising means for displaying advertisements.

15. A carton adapted to be used as a shipping carton and a display stand, said carton comprising:

a top wall;

a bottom wall;

a first side wall located adjacent to said bottom wall;

a second side wall located adjacent to said top wall;

a plurality of shelves;

a plurality of insert panels connected to said first side wall and said second side wall for providing rigidity to the display stand and allowing said plurality of shelves to be removably connected to said plurality of insert panels;

wherein the carton is adapted to be used as the shipping carton for shipping the merchandise and the display stand for displaying the merchandise.

16. A carton as recited in claim 15 wherein said plurality of insert panels are plastic.

17. A carton as recited in claim 15 wherein said plurality of shelves are plastic.

18. A carton as recited in claim 15 wherein said plurality of insert panels include:

first insert panel connected to said first side wall;

a second insert panel connected to said second side wall;

each of said first insert panel and said second insert panel having a plurality of ribs and a plurality of slots; and each of said plurality of ribs of said first insert panel and said second insert panel having a notch.

19. A carton as recited in claim 18 wherein each of said plurality of shelves include a rim;

a pair of finger members are formed on each of said rim; wherein said plurality of shelves are removably inserted into said plurality of slots and said pair of finger members engage said notches of said plurality of ribs, respectively.

20. A carton as recited in claim 19 wherein said top wall includes:

a front panel;

a top wall flap; and a center panel located between said front panel and said top wall flap;

said bottom wall includes:

a bottom wall flap;

an end panel; and a floor panel located between said bottom wall flap and said end panel; and said first side wall includes:

a first rear panel;

a first inner side panel located adjacent to said first rear panel;

a first side wall flap located adjacent to said first inner side panel;

a first end flap;

a first outer side panel located between said first inner side panel and said first end flap; and said second side wall includes:

a second rear panel;

a second inner side panel located adjacent to said second rear panel;

a second side wall flap located adjacent to said second inner side panel;

a second end flap; and a second outer side panel located between said second inner side panel and said second end flap.

21. A carton as recited in claim 20 wherein said plurality of insert panels further include:

a third insert panel connected to said first rear panel and said second rear panel, and said third insert panel having a plurality of ribs and a plurality of slots.

22. A carton as recited in claim 21 wherein said end panel includes:

a first portion;

a second portion located adjacent to said first portion;

a third portion located adjacent to said second portion;

a fourth portion located adjacent to said third portion; and said first end flap includes:

a first member;

a second member located adjacent to said first member; and said second end flap includes:

a third member; and a fourth member located adjacent to said fourth member.

23. A carton as recited in claim 21 further comprising fastening means for connecting said first end flap to said first rear panel and connecting said second end flap to said second rear panel.

24. A carton as recited in claim 15 further comprising a base member proximately located to said bottom wall.

25. A carton as recited in claim 21 wherein said front panel, said first outer side panel, and said second outer side panel further comprise advertising means for displaying advertisements.

* * * * *